US005728986A

United States Patent [19]

Bennett et al.

[11] Patent Number: 5,728,986

[45] Date of Patent: Mar. 17, 1998

[54] BLOCK MOUNTING OF PRESSURE SWITCH CARTRIDGE

[75] Inventors: Larry P. Bennett, Franklin; Maria T. Warzecha, Shelby Township; Harold L. Bowman, Lapeer, all of Mich.

[73] Assignee: Eaton Corporation, Cleveland, Ohio

[21] Appl. No.: 771,077

[22] Filed: Dec. 20, 1996

[51] Int. Cl.[6] ..... H01H 35/34

[52] U.S. Cl. ..... 200/81.4; 200/83 J; 200/302.1

[58] Field of Search ..... 200/81 R, 81.4, 200/81.5, 82 R, 82 C, 83 R, 83 A, 83 B, 83 P, 83 J, 83 Q, 83 V, 293, 294, 296, 302.1, 303

[56] References Cited

U.S. PATENT DOCUMENTS

| | | | |
|---|---|---|---|
| 3,319,024 | 5/1967 | Quatredeniers | 200/83 |
| 3,594,522 | 7/1971 | Colglazier et al. | 200/83 N |
| 4,195,209 | 3/1980 | Mlyniec | 200/83 R |
| 4,508,014 | 4/1985 | Shoff | 91/527 |
| 4,861,953 | 8/1989 | Sanford | 200/83 P |
| 5,004,876 | 4/1991 | Sogge et al. | 200/83 P |
| 5,338,908 | 8/1994 | Rahman et al. | 200/83 P |
| 5,422,791 | 6/1995 | Bentz et al. | 361/823 |

*Primary Examiner*—Michael L. Gellner
*Assistant Examiner*—Michael A. Friedhofer
*Attorney, Agent, or Firm*—Roger A. Johnston

[57] ABSTRACT

A cartridge type pressure switch is formed with a cup-shaped contact flanged outwardly at its rim and slidably nested in an annular spacer. A flexible diaphragm has an integrally formed annular bead ring which is stretched over the spacer to secure the diaphragm in place over the cup-shaped contact. A spring nested in the cup-shaped contact has the outer end registered against a deck or spring retainer. A pair of stationary contacts on opposite sides of the spacer have terminal portions extending outwardly through the deck. The spring biases the cup-shaped contact in a direction to seat the flange against the stationary contacts. When the cartridge is inserted in a bore, the bead ring is compressed to seal the cartridge in the bore. When a plurality of cartridges are received in bores in a block or manifold, a spacer and lead frame are commonly received over the terminal portions of the contacts on each cartridge for providing electrical connection; and, a cover is received over the lead frame and attached to the block. Alternatively a single cartridge is inserted in a bore and retained by a plate, with terminal pins connected to cut outs in the terminal portions of the contacts.

15 Claims, 3 Drawing Sheets

BLOCK MOUNTING OF PRESSURE SWITCH CARTRIDGE

STATEMENT REGARDING FEDERALLY SPONSORED RESEARCH OR DEVELOPMENT

Not Applicable

CROSS-REFERENCE TO RELATED APPLICATIONS

Not Applicable

MICROFICHE APPENDIX

Not Applicable

BACKGROUND OF THE INVENTION

The present invention relates to pressure responsive switches operative to make and break a set of electrical contacts in response to changes in sensed fluid pressure. The invention particularly relates to cartridge type or self contained pressure switches which are mounted in a bore in a block or base structure which is ported to a source of pressurized fluid. This type of pressure switch installation is particularly suitable for applications where a plurality of such switches are required for sensing pressure in a multiplicity of bores or cavities, as for example, multiple cavities mounted in a block or manifold with each cavity ported to a separate fluid pressure source.

Examples of the aforesaid type mounting of pressure switches on a block or manifold are found in automatic power transmissions employed in light trucks and passenger cars where it is desired to electrically monitor the pressure of the various shift control valves to determine whether a fault is present in the operation of the transmission.

Furthermore, it may be desired to install a pressure switch in a bore or cavity in an existing fluid pressure operated system such as, for example, a fuel injection circuit where it is not feasible to have the pressure switch connected or mounted on a threaded fitting.

Heretofore cartridge type pressure switches have employed a metallic domed or dished member as the pressure responsive member. This arrangement has the disadvantage that movement of the diaphragm exhibits a snap action and thus results in an unpredictable differential between actuation and de-actuation of the pressure responsive member. The unpredictability and variation in the difference between actuation and deactuation of the responsive member in such a cartridge type pressure switch prohibits the switch from sensing small changes in pressure about a nominal pressure setting. In addition, such pressure switches have been found to be relatively costly in high volume mass production where a multiplicity of such switches are required for a given application.

It has therefore long been desired to find a way or means for providing a cartridge type pressure switch which has a low cost in high volume mass production and which has a high degree of sensitivity to small pressure changes and is reliable and has an extended service life suitable for automotive applications.

BRIEF SUMMARY OF THE INVENTION

It is an object of the present invention to provide a simplified low cost and reliable cartridge type pressure switch for use in extended service applications.

It is a further object of the present invention to provide a cartridge type pressure switch for mounting and self-sealing in a bore in a base or body structure and to electrically connect to and secure in place a plurality of such cartridge type switches in a manifolded arrangement.

The present invention provides a cartridge type pressure switch which is mounted and self-seals in a cavity ported to a fluid pressure source with a lead frame received thereover for bayonet direct contact of the pressure switch terminals with conductive strips provided in the lead frame. A retaining plate sandwiches the lead frame over the pressure switches and attachment of the retaining plate to the structure in which the pressure switch cavity is formed retains the lead frame and pressure switches in place.

The pressure switch cartridge has an annular spacer which has a cup-shaped contact member slidably received therein with a pair of spaced electrical contacts disposed against one axial face of the spacer. The cup-shaped contact member is nested in the spacer and is flanged outwardly so as to contact a pair of stationary electrical contacts. A deck member is received over the electrical terminals and retains a bias spring for biasing the contact member in a direction toward the spaced contacts. An elastomeric diaphragm has a bead formed about the periphery thereof which is stretched over the spacer to hold the diaphragm in place and against the surface of the cup-shaped contact member. Increasing pressure in the sensing cavity acts upon the diaphragm and moves the cup-shaped contact member away from the contacts thus breaking electrical continuity therebetween.

DETAILED DESCRIPTION OF THE INVENTION

Figure 4:
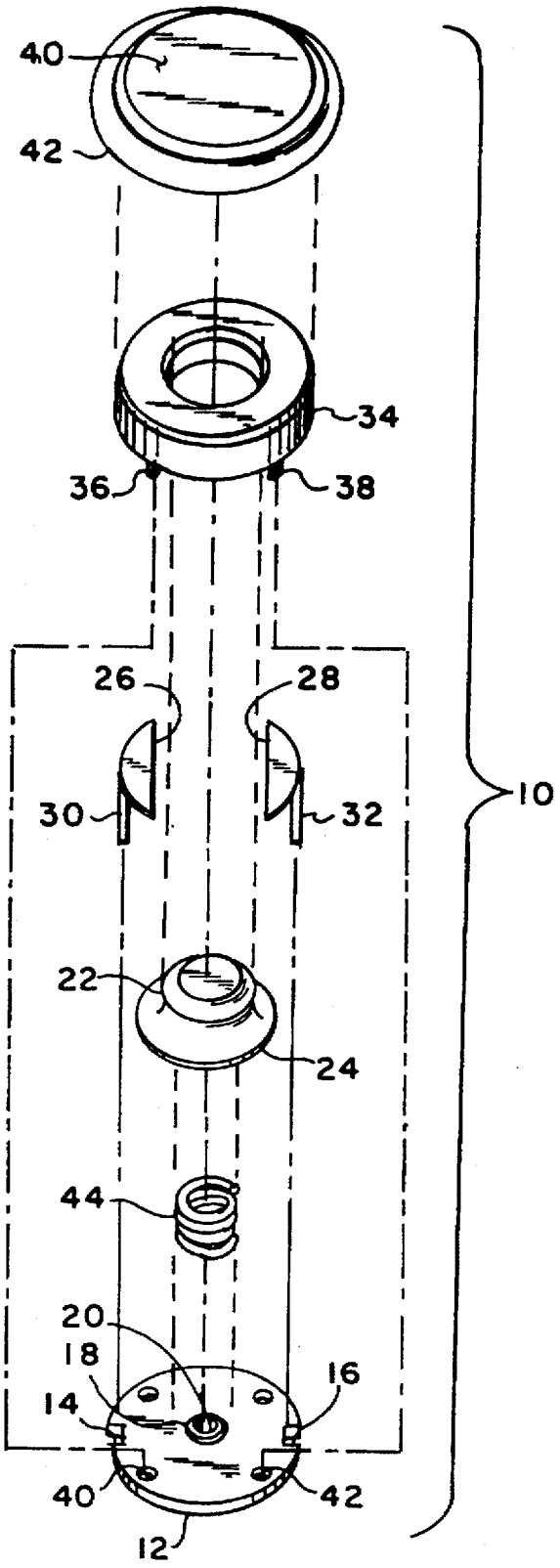

Referring to FIG. 4, the cartridge type pressure switch of the present invention is indicated generally at 10 and includes a deck or spring retainer 12 having a generally disc-shaped configuration with a pair of diametrally opposed notches or slots 14, 16 formed therein and a spring pilot 18 disposed annularly around a central orifice 20. The deck 12 is preferably formed of dielectric material such as a suitable thermoplastic.

A generally cup-shaped piston 22 has a radially outwardly extending rim flange 24 formed integrally therewith, and the member 22 is formed of electrically conductive material to provide a moveable electrical contact.

A pair of stationary electrical contacts 26, 28 each have a downwardly extending connecting terminal portion respectively 30, 32; and, the contacts 26, 28 are disposed in diametrally opposed spaced arrangement with the terminals 30, 32 received respectively in the slots 14, 16 of base 12. The contacts 26, 28 overlie the flange 24 of the piston 22.

A spacer sleeve 34 has an annular configuration with a plurality of mounting or aligning projections 36, 38 extending downwardly therefrom which are received in apertures 40, 42 respectively in the base 12. Spacer 34 is formed of dielectric material and has the contacts 26, 28 preferably received therein as, for example, by insert molding of the spacer 34 about the pre-placed contacts 26, 28. It will be understood that in such an arrangement the undersurface of the contacts 26, 28 is left exposed for making contact with the flange 24 of piston 22.

A flexible diaphragm 40 has the periphery thereof formed integrally as an annular bead or rim 42 and the diaphragm and bead are preferably formed of molded elastomeric material as, for example, fluorosilicone material.

Figure 2:
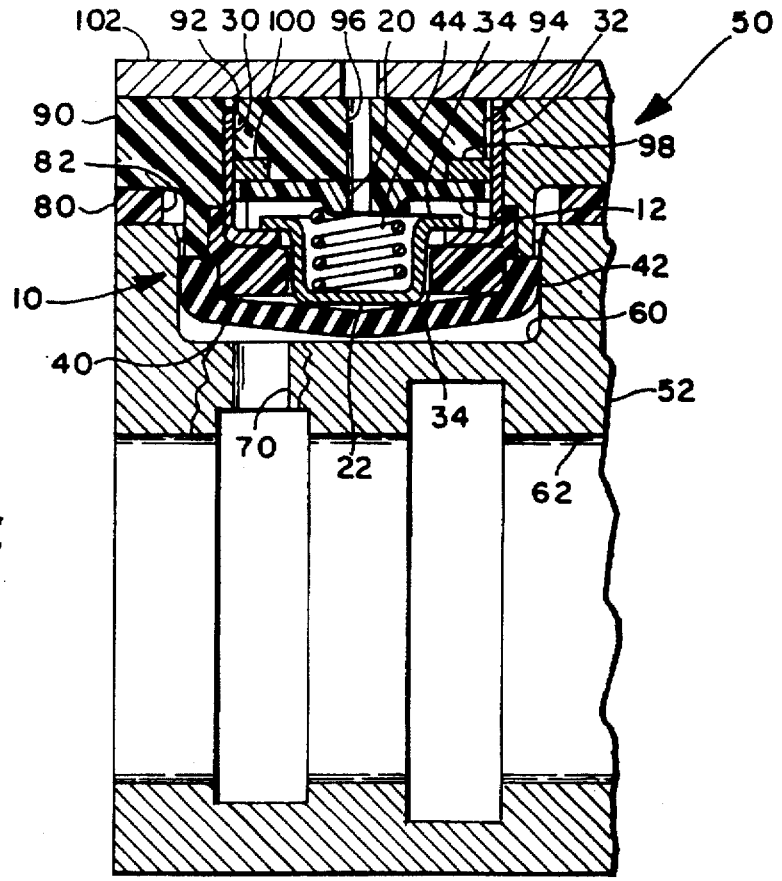
FIG. 2 is a cross-section of the assembled device of FIG. 1 taken along section indicating lines 2—2 of FIG. 1.

Referring to FIG. 2, the cartridge 10 is shown in the assembled state with the bead 42 of the diaphragm 40 stretched over the outer periphery of the spacer 34 with the undersurface of the diaphragm 40 contacting the cup-shaped contact piston 22.

Referring to FIGS. 2 and 4, a bias spring 44 has the upper end thereof registered against the undersurface of piston 22 and the opposite end registered over pilot 18 on base 12. A spring 44 urges the piston against the undersurface of the diaphragm 40 in an upward direction in FIG. 4 so as to cause the flange 24 of the piston to engage the undersurface of contacts 26, 28. It will be understood that the cartridge assembly 10 is illustrated inverted in FIG. 2 with respect to the exploded view of FIG. 4.

Figure 1:
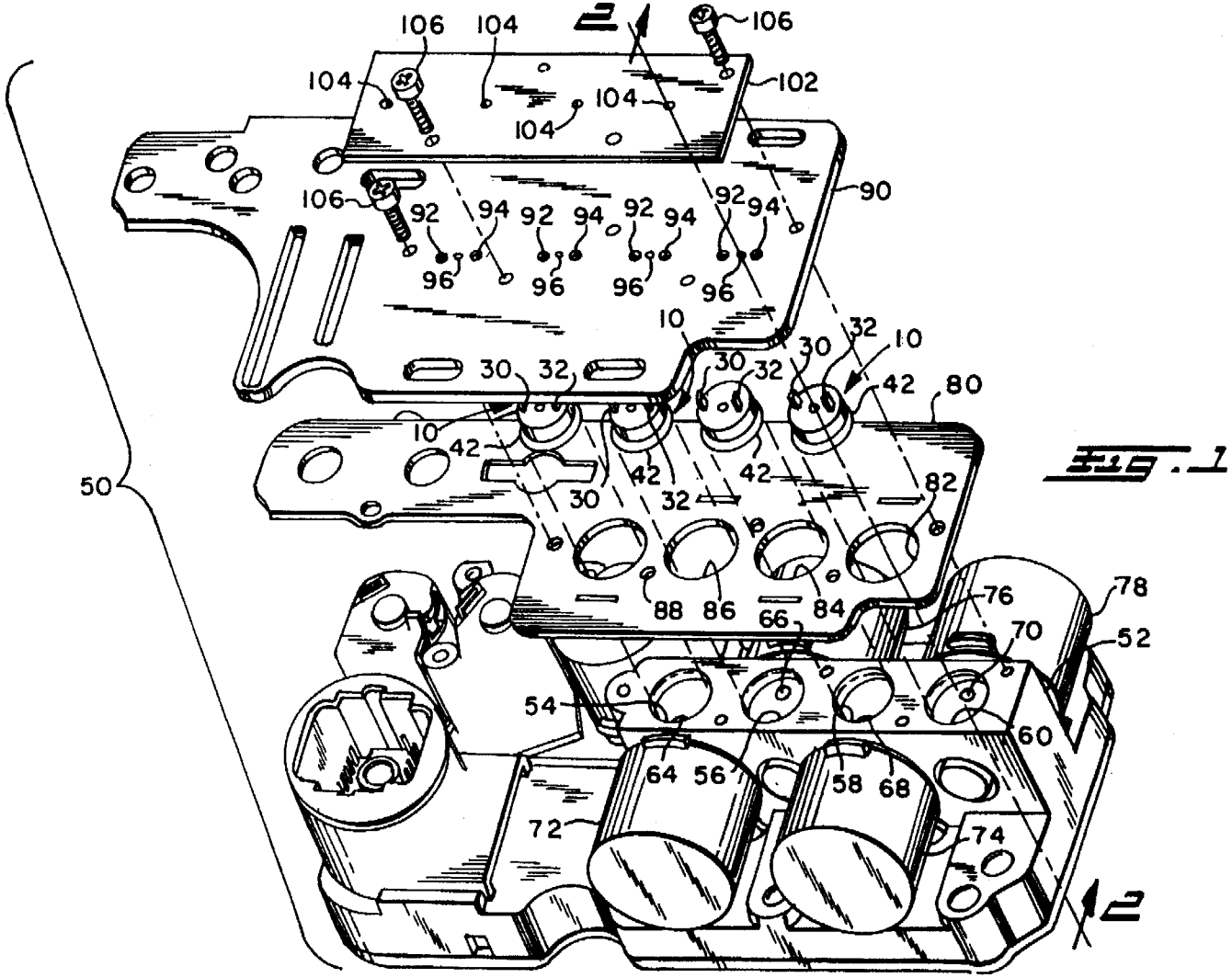
FIG. 1 is an exploded view of a manifold with a plurality of the cartridge type pressure switches of the present invention mounted therein.

Referring to FIGS. 1 and 4, a manifold or block assembly indicated generally at 50 has a plurality of the pressure switch cartridges 10 mounted thereon as will hereinafter be described. Manifold assembly 50 includes a manifold or block 52 having a plurality of bores or cavities 54 through 60 formed on the upper surface thereof with each of the bores having ports 64 through 70 formed respectively therein for communication the bores with a source of fluid pressure such as a valved passage 72 illustrated in FIG. 2. Each of the ports 64 through 70 is individually valved respectively by an electrically operated valve denoted by reference numerals 72 through 78. Each of which is operative to electrically control flow to one of the ports 64 through 70.

Referring to FIG. 2, port 70 is illustrated as ported to bore 60 with the port 70 being connected to a valved passage 62 formed within the block 52.

Referring to FIG. 1, one of the pressure switch cartridges 10 is received in each of the bores 54 through 60 with the diaphragm bead 42 thereof sealing in the bore by radial compression thereof.

A spacer plate 80 is received over the cartridges 10 which extend upwardly through clearance apertures 82 through 88 which are formed in the plate 80 and located so as to coincide with the bores 54 through 60 formed in the block 52. The cartridges 10 thus extend upwardly through the spacer.

A lead frame 90 is received over the spacer 80 and registered thereagainst. Spacer 80 has a plurality of holes 92, 94 provided at the corresponding station for each of the pressure switch capsules 10, with the terminals 30, 32 extending upwardly through the holes respectively 92, 94. The spacer plate also has an aperture 96 formed between the apertures 92, 94 at each station of the pressure switches on lead frame 90 to vent the area above the diaphragm 40.

Referring to FIG. 2, the lead frame 90 has embedded therein and exposed on the undersurface thereof a plurality of electrically conductive strips 98, 100 which have the edges thereof respectively in contact with the terminal strips 32, 30 for providing electrical connection to the pressure switch cartridge 10. In the presently preferred practice, the lead frame 90 is formed of thermoplastic material and strips 98, 100 are insert molded therein.

A cover plate 102 is provided over the lead frame 90; and, cover 102 has apertures formed therein to coincide with the vent apertures 96 provided in the lead frame 90 as denoted by reference numeral 104 The cover 102, lead frame 90 and spacer 80 and switch cartridges 10 are secured in a sandwich arrangement by suitable fasteners such as screws 106 received through apertures formed in the individual components with the screws engaging threaded or tapped holes in the block 52.

Figure 3:
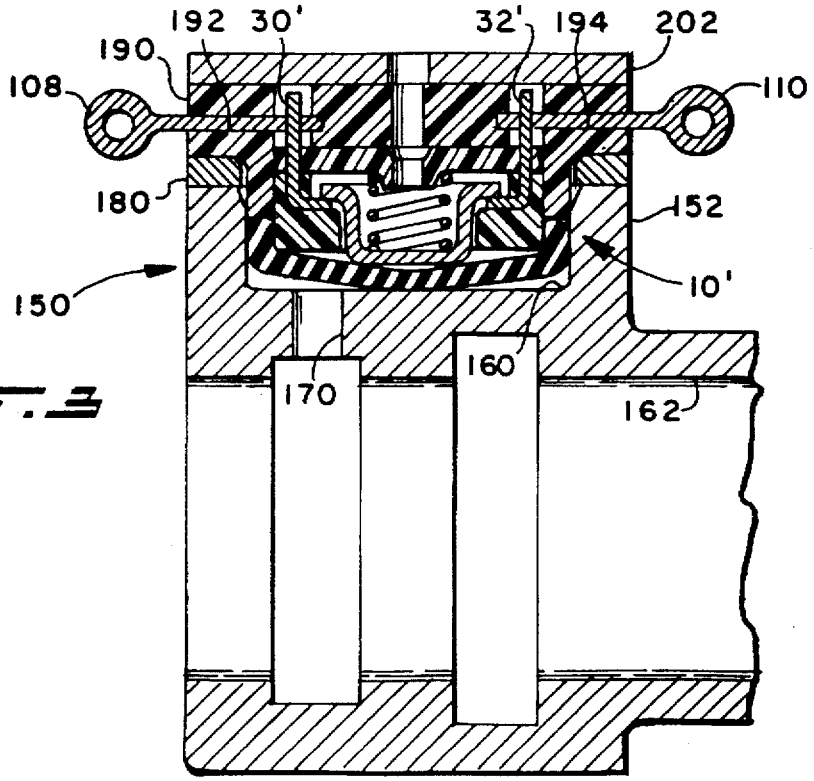
FIG. 3 is a view similar to FIG. 2 of an alternate embodiment of the invention; and, FIG. 4 is an exploded view of the cartridge type pressure switch of the present invention.

Referring to FIG. 3, an alternate embodiment of the invention is illustrated wherein a single pressure switch cartridge 10' is received in a bore 160 formed in a body 152 with bore 160 connected via port 170 to a fluid pressure supply passage 162 and forms a block assembly indicated generally at 150. The pressure switch cartridge 10' has the components thereof and the assembly thereof formed identical to that of the cartridge 10 of the embodiment of FIG. 1.

In the embodiment 150 of FIG. 3, the lead frame 190 does not have conductor strips insert molded therein but instead has apertures 198, 200 formed therein through which are received electrical connector pins 108, 110 which are received through apertures or slots provided in the terminals 30', 32' in the manner illustrated in FIG. 3.

The cartridge 10', spacer 180 and frame 190 are retained by a cover plate 202 which is secured thereon by fasteners in the same manner as the plate 102 of the FIG. 1 embodiment.

The present invention thus provides a unique low cost, simple to assemble and reliable cartridge type pressure switch and technique for mounting same in a bore ported to a fluid supply in a block or manifold where a multiplicity of such cartridges are required for plural pressure signal sensing. The common lead frame is received over the cartridges with the terminals of each cartridge inserted into the lead frame and connecting to connector strips insert molded therein. Alternatively, for a single cartridge mounting, the cartridge terminals may have slots or cut-outs formed therein for insertion of electrical connections individually thereto.

The cartridge is formed by a cup-shaped electrical contact nested in a dielectric spacer which has a pair of spaced stationary contacts mounted therein portions of which extend outwardly for forming electrical connection terminals. A spring is received in the cup and is registered against the undersurface of a spring retainer or deck. An elastomeric diaphragm has an integrally molded bead about the periphery which is stretched over the spacer such that the membrane is in contact with the nested cup-shaped contact. The cup-shaped contact has a flanged rim which completes a circuit with the stationary contacts on the spacer. Cartridge is inserted in a bore and the bead rim of the diaphragm seals thereabout such that fluid pressure in the bore acts on the diaphragm and raises the cup-shaped contact to break the circuit with stationary contacts when a predetermined pressure is experienced by the diaphragm.

The present invention thus provides a unique low cost pressure switch cartridge which may be inserted in a bore and provides self-sealing therein; and, a plurality of the cartridges may be retained and electrically connected thereto simultaneously by a lead frame having the plurality of conductors therein being received over the cartridges.

Although the invention has hereinabove been described with respect to the illustrated embodiments, it will be understood that the invention is capable of modification and variation and is limited only by the following claims.

We claim:

1. A fluid pressure sensing manifold assembly comprising:

(a) a manifold body defining a fluid pressure passage having an inlet and a plurality of outlet ports spaced thereon, with each outlet communicating with said passage and each outlet port having an enlarged cavity formed thereon opening to an exterior surface of said body;

(b) a plurality of self contained pressure switch cartridges each having a pressure responsive member with an annular seal ring formed thereon, said cartridges having a plurality of connector terminals with one of said cartridges received in each of said outlet port cavities with said seal ring providing a fluid pressure seal thereon and with said terminals extending outwardly of said cavity;

(c) a conductor lead frame formed of dielectric material and having a plurality of electrical conductor strips thereon, said frame having a plurality of sockets therein with each of said terminals received in one of said sockets and connecting with one of said conductor strips; and, (d) a cover received over said lead frame and secured to said body wherein said lead frame and said cartridges are retained by said cover.

2. The manifold assembly defined in claim 1, wherein said lead frame has a plurality of annular portions formed thereon, with each of said annular portions retaining one of said cartridge seal rings in one of said cavities.

3. The manifold assembly defined in claim 1, wherein each of said cartridges has an electrically conductive member contacting said pressure responsive member for movement therewith and operable to make and break electrical connections between two of said terminals.

4. The manifold assembly defined in claim 3, wherein said electrically conductive member has a generally cup-shaped configuration.

5. The manifold assembly defined in claim 1, wherein said cartridges have said pressure responsive member comprising a flexible diaphragm with said seal formed integrally about the periphery thereof.

6. A method of sensing pressure in a passage in a body member having a port connecting to a source of fluid pressure comprising:

(a) forming a bore in said body member and porting said bore for communicating with said passage;

(b) forming a pressure switch having electrical terminals and disposing a flexible diaphragm over an end of the switch and forming an annular seal integrally about the periphery of said diaphragm and disposing said seal about said switch and forming a cartridge;

(c) disposing said cartridge in said bore and deforming said annular seal and sealing said cartridge in said bore;

(d) disposing a lead frame with conductors thereon over said bore and electrically connecting said conductors directly with said terminals; and (e) disposing a retaining member over said lead frame and retaining said frame on said body and said cartridge in said bore.

7. The method defined in claim 6, wherein said step of directly connecting said terminals to said conductors includes inserting said terminals in receptacles formed in said lead frame.

8. The method defined in claim 6, wherein said step of disposing said diaphragm over said cartridge comprises stretching said annular seal over a periphery of said cartridge.

9. The method defined in claim 6, wherein said step of deforming said seal comprises radially compressing said seal between said bore and said cartridge.

10. The method defined in claim 6, wherein said step of disposing a retaining member comprises attaching said retaining member to said body member.

11. The method defined in claim 6, wherein said step of disposing a retaining member includes disposing a spacer between said lead frame and said body member.

12. A pressure switch cartridge being received in a bore ported to a source of fluid pressure comprising:

(a) an annular spacer member formed of dielectric material;

(b) an electrically conductive member having a generally cup-shaped configuration with a rim thereof flanged outwardly, said cup-shaped member slidably nested in said spacer member;

(c) a base or deck member formed of dielectric material having a pair of spaced electrical contact members each having a portion thereof extending from said deck and other portions thereof registered against an axial face of said spacer member;

(d) a flexible diaphragm having an annular seal formed integrally therewith about the periphery thereof, said seal stretched a predetermined amount over the periphery of said spacer member and retaining said diaphragm thereon, with one face thereof contacting said cup-shaped member; and, (e) a spring operative to bias said cup-shaped member for sliding movement in a direction causing said outwardly flanged rim for making contact with said pair of spaced contacts for making a circuit therebetween, wherein said cartridge being received in said bore, and sealed therein and upon exposure of said diaphragm to a predetermined level of said fluid pressure said diaphragm moves said contact away from said pair of electrical contacts.

13. The cartridge defined in claim 12, wherein said diaphragm is formed of fluorosilicone elastomer.

14. The cartridge defined in claim 12, wherein each of said pair of contacts had integral portions thereof extending outwardly of said bore and forming external connecting terminals.

15. The cartridge defined in claim 12, wherein said spring member comprises a coil spring having one end thereof registered in said cup-shaped member and an opposite end registered against said base member.

* * * * *